US006484421B1

(12) United States Patent
Donoghue

(10) Patent No.: US 6,484,421 B1
(45) Date of Patent: Nov. 26, 2002

(54) SNOW PLOW ASSEMBLY

(76) Inventor: John Barry Donoghue, 24 W. Mountain Rd., W. Simsbury, CT (US) 06092

( * ) Notice: Subject to any disclaimer, the term of this patent is extended or adjusted under 35 U.S.C. 154(b) by 0 days.

(21) Appl. No.: 09/671,782

(22) Filed: Sep. 27, 2000

(51) Int. Cl.[7] ..... E01H 5/04
(52) U.S. Cl. ..... 37/231; 37/234
(58) Field of Search ..... 37/231, 234, 235, 37/266, 270, 271, 273, 277, 283, 348

(56) References Cited

U.S. PATENT DOCUMENTS 4,470,211 A * 9/1984 Rossman
4,731,942 A * 3/1988 Eberle
4,976,054 A * 12/1990 Jones
5,195,261 A * 3/1993 Vachon
5,778,567 A * 7/1998 Jager et al.
5,924,233 A * 7/1999 Hone, Jr.
6,009,642 A * 1/2000 Nugent
6,102,131 A * 8/2000 Malinowski
6,154,122 A * 11/2000 Menze
6,176,668 B1 * 1/2001 Gustafson et al.

* cited by examiner

*Primary Examiner*—Thomas B. Will
*Assistant Examiner*—Kristine Markovich
(74) *Attorney, Agent, or Firm*—Bachman LaPoint, P.C.

(57) ABSTRACT

A snow plow assembly broadly comprises a snow plow blade, a frame for mounting the snow plow blade to a vehicle, and a boom connected to the frame and the snow plow blade. The assembly also includes a lift system for raising and lowering the boom, which lift system includes a lift cable attached to the frame and the boom. The assembly also includes a system for maintaining the lift cable taut so that the snow plow blade remains substantially level during use.

35 Claims, 11 Drawing Sheets

SNOW PLOW ASSEMBLY

SUMMARY OF THE INVENTION

The present invention relates to an improved snow plow assembly for use with a wheeled vehicle such as a truck or an automobile.

Many different types of snow plow assemblies are known in the prior art. Conventional snow plow assemblies include a blade and a frame for coupling the blade to the front of the vehicle. More sophisticated snow plow assemblies also include a mechanism for adjusting the angular orientation of the plow blade relative to the longitudinal axis of the vehicle for elevating the snow plow blade relative to the road surface to permit the vehicle to be driven from one location to another. Still other snow plow assemblies include mechanisms for adjusting the angular orientation of the snow plow blade relative to the longitudinal axis of the vehicle so as to push snow left or right as the vehicle traverses the surface being cleared of snow.

SUMMARY OF THE INVENTION

Accordingly, it is an object of the present invention to provide an improved snow plow assembly having a device for leveling the snow plow blade and keeping it level during use.

It is a further object of the present invention to provide an improved frame structure for a snow plow assembly.

It is still a further object of the present invention to provide an improved control system for the snow plow assembly.

The foregoing objects are attained by the snow plow assembly of the present invention.

In accordance with the present invention, a snow plow assembly broadly comprises a snow plow blade, a frame for mounting the snow plow blade to a vehicle, and a boom connected to the frame and the snow plow blade. The assembly further comprises a lift system for raising and lowering the boom, which lift system includes a lift cable attached to the frame and the boom. The snow plow assembly also includes means for maintaining the lift cable taut so that snow blow blade remains substantially level during use. This leveling system is needed in the snow plow blade assembly of the present invention because the snow plow blade has an extraordinary wide range of side to side movement.

Other details of the present invention, as well as other objects and advantages attendant thereto, are set forth in the following detailed description and the accompanying drawings, wherein like reference numerals depict like elements.

DETAILED DESCRIPTION OF THE PREFERRED EMBODIMENT(S)

Figure 1:
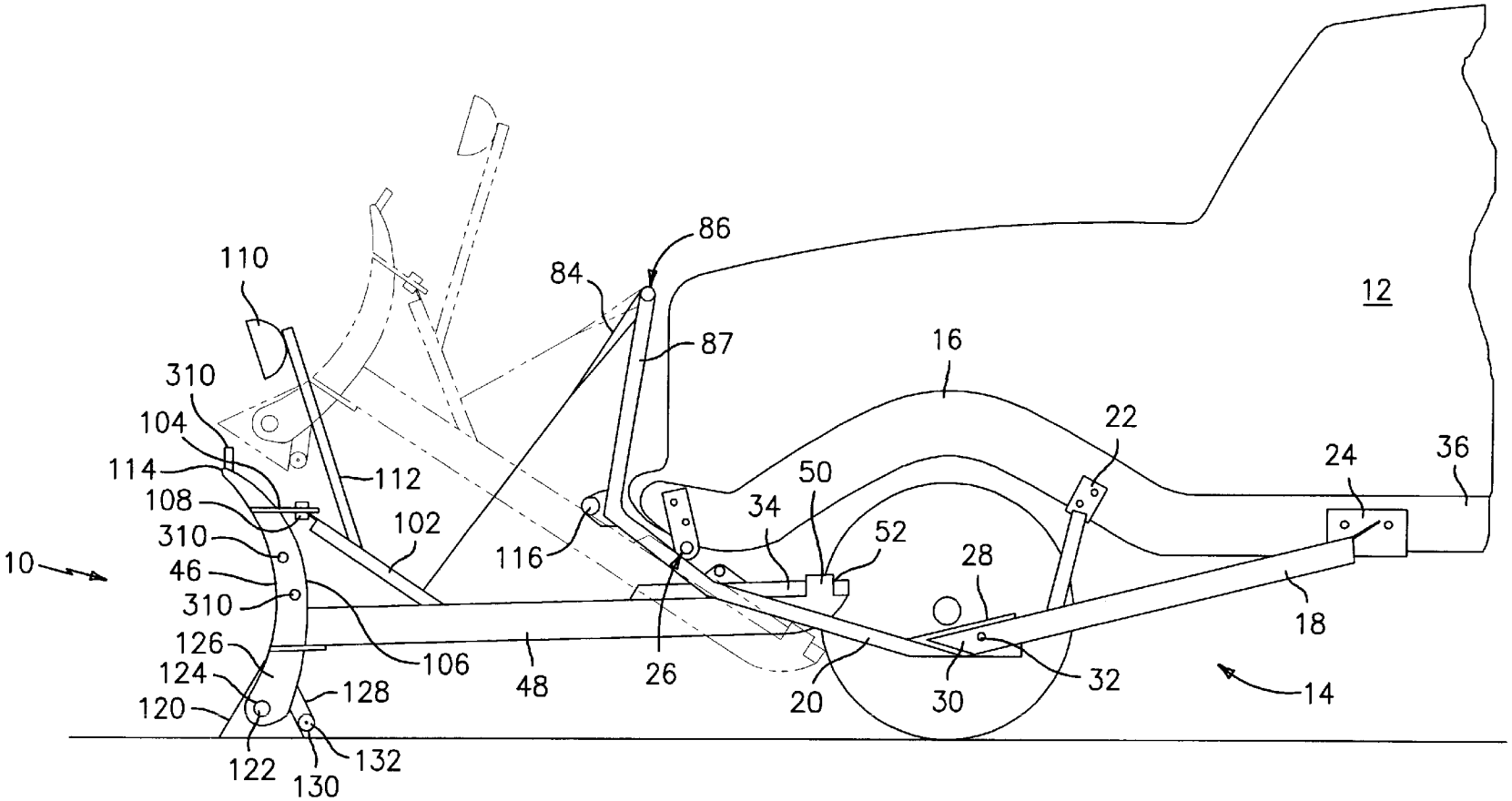
FIG. 1 is a side view of a vehicle with snow plow assembly in accordance with the present invention.

Referring now to the drawings, FIG. 1 illustrates a snow plow assembly 10 mounted to the front end of a vehicle 12. The vehicle 12 has a support frame 14 for supporting the snow plow assembly. The support frame 14 is connected to the vehicle frame 16.

Figure 2:
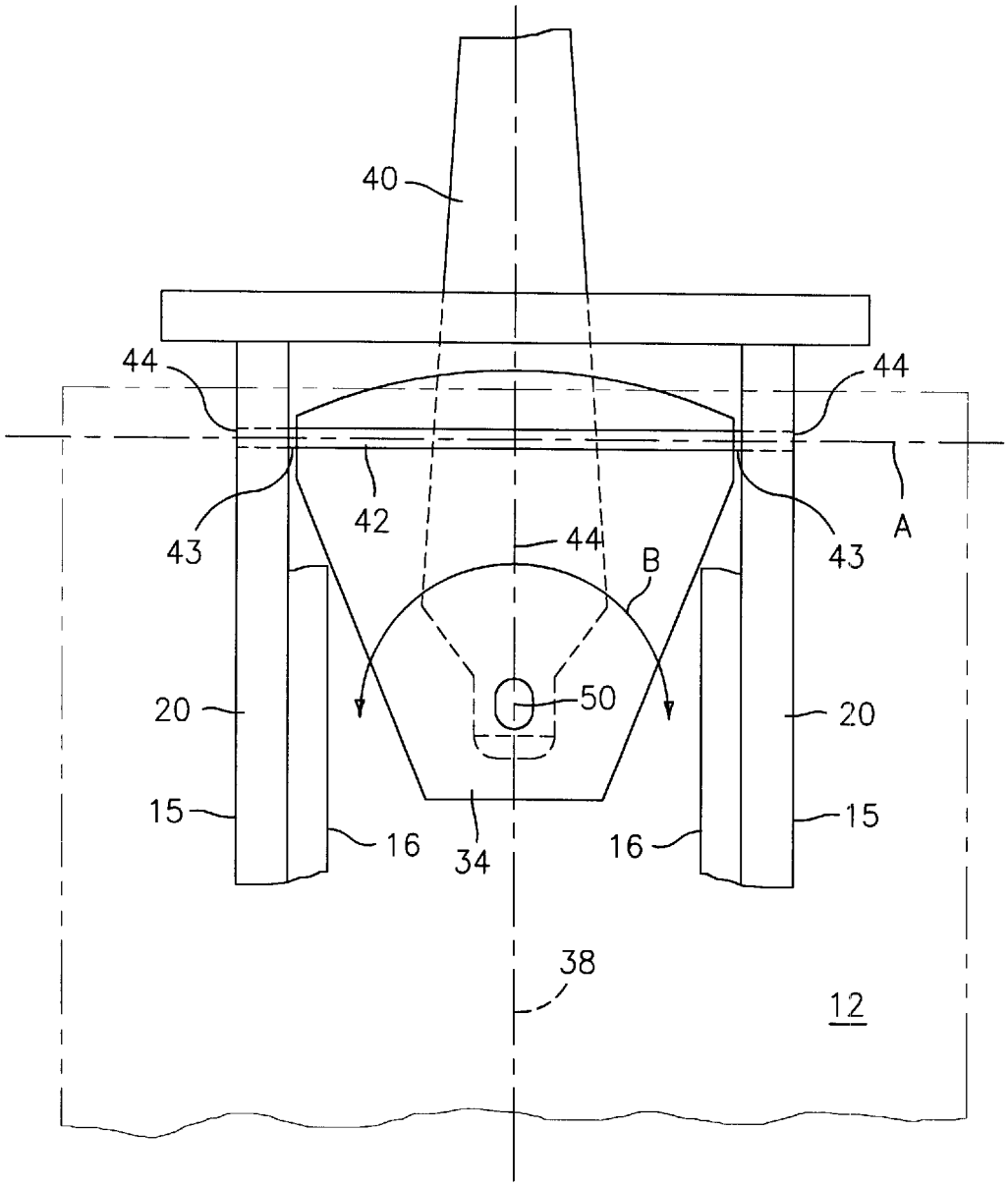
FIG. 2 is a top view of a portion of the frame for supporting the snow plow assembly of FIG. 1.

Referring now to FIGS. 1 and 2, the support frame 14 has two side portions 15 attached to the vehicle frame 16. Each side portion 15 includes first and second frame members 18 and 20, respectively. Each first frame member 18 is mounted to an outside portion 36 of the vehicle frame 16 by connecting members 22 and 24 which are both bolted to the outside portion 36. The connecting members 22 and 24 may be joined to the respective first frame member 18 in any suitable manner known in the art. Each second frame member 20 is mounted to the outside portion 36 of the vehicle frame 16 by a quick connect/disconnect member 26. As shown in FIG. 1, each second frame member 20 has a funnel shaped portion 28 which receives a free end 30 of a respective first frame member 18. The free end 30 is preferably connected to the funnel portion 28 via a quick connect/disconnect device 32. The quick connect/disconnect devices 26 and 32 may comprise any suitable quick connect/disconnect devices known in the art.

The support frame 14 has an upper frame portion 86 which extends across the front of the vehicle 12 and which is structurally connected to each side portion 15 by upwardly extending members 87.

The support frame 14 further includes a support plate 34 positioned between the two second frame members 20. The support plate 34 is hingedly mounted to each second frame member 20 for rotation about a substantially horizontal axis A. The axis A is substantially perpendicular to the central longitudinal axis 38 of the vehicle 12. The support plate 34 is hingedly mounted to each second frame member by a tubular member 42 which is joined to an upper portion of the support plate and which has two ends 43 which extend into apertures or bores 44 in the frame members 20. While it is currently preferred to use this tubular member-bore system, other types of hinge connections could be used. For example, the support plate 34 may have two stub axles extending from two sides of the support plate. The stub axles can be received in sockets in connecting devices mounted on or in the frame members 20 so that the support plate 34 can rotate about a substantially horizontal axis defined by the stub axles.

The support plate 34 is preferably positioned so that its central axis 44 coincides with the central longitudinal axis 38 of the vehicle. As shown in FIG. 1, the snow plow assembly 10 includes a snow plow blade 46 which is connected to the frame 14 via a boom 48 joined to the support plate 34. The boom 48 may have any desired configuration or shape. The boom 48 preferably has an integrally formed crank pin 50 which fits into a receiving bore 52 in the support plate 34. As can be seen from FIG. 1, the support plate 34 lies above a rear portion of the boom 48. The crank pin 50 allows the boom 48 to be moved through an arc B with respect to the central axis 44 of the support plate 34 and the central longitudinal axis 38 of the vehicle 12. Movement of the boom 48 through the arc B allows the snow plow blade 46 to be moved to one side or the other with respect to the central longitudinal axis 38 of the vehicle 12.

Figure 3:
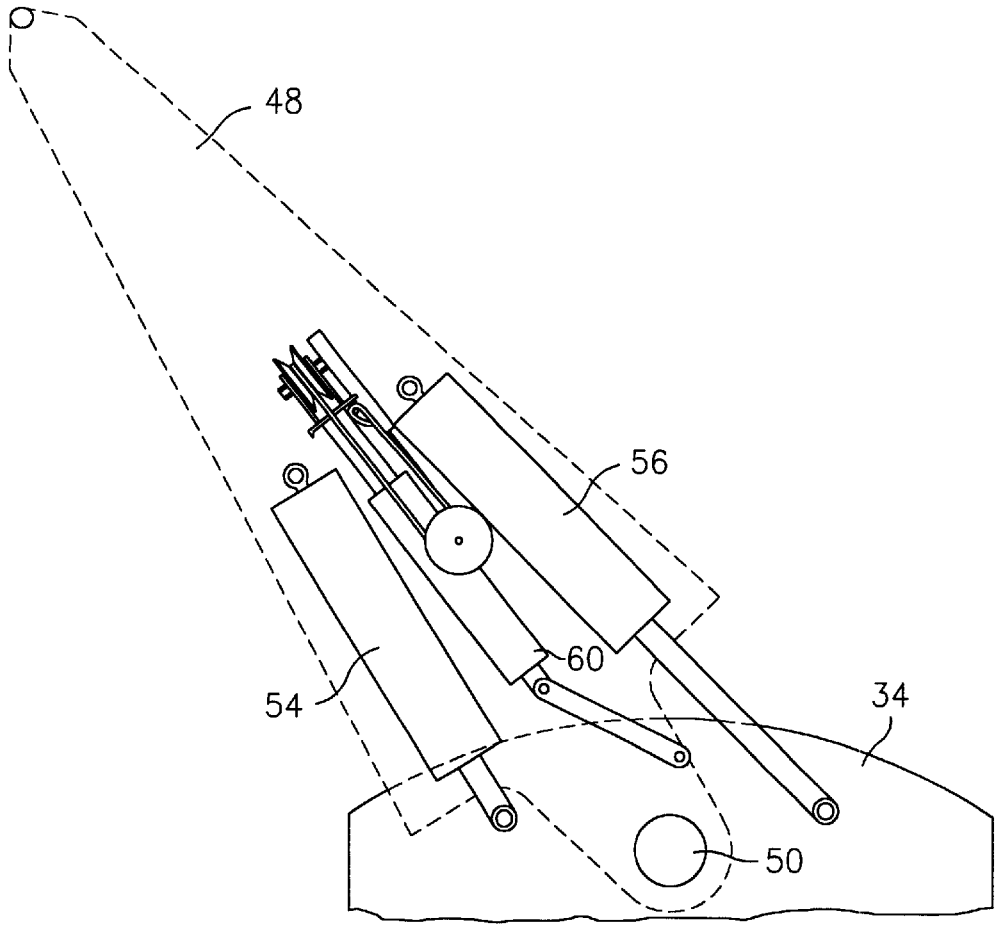
FIGS. 3 and 4 are bottom views of the boom of the snow plow assembly.
Figure 4:
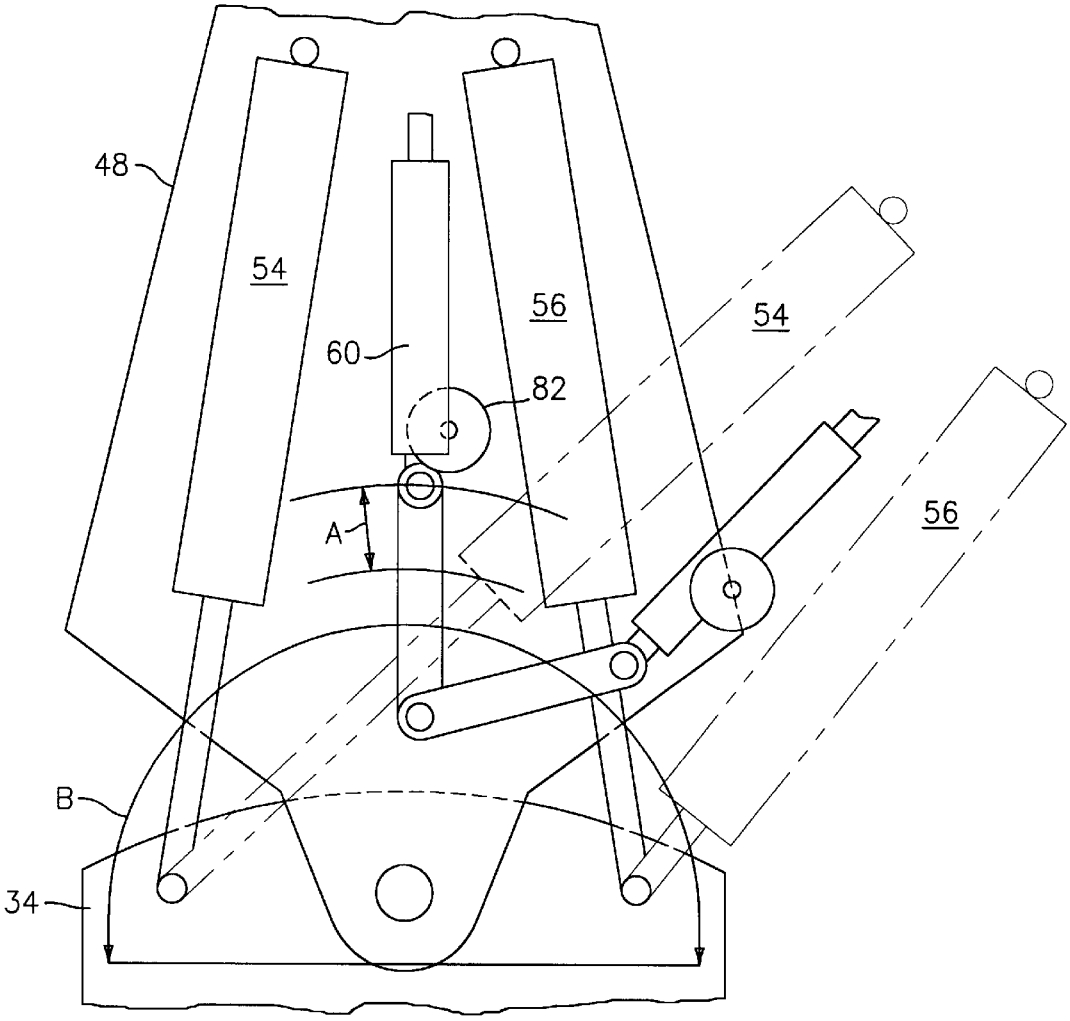

As shown in FIGS. 3 and 4, two fluid actuated drive units 54 and 56 respectively may be connected at one end to the support plate 34 and at the other end to the boom 48. By differentially actuating the drive units 54 and 56, the boom 48 may be swung through the arc B. The drive units 54 and 56 may comprise piston-cylinder units or any other suitable actuation units known in the art. If desired, the boom 48 may be swung through the arc B using the system shown in U.S. Pat. No. 5,974,702 to Donoghue, which is hereby incorporated by reference herein.

As previously discussed, the support plate 34 is connected to the frame members 20 so that it can rotate about an axis A. Since the support plate 34 is rotatable upwardly and downwardly, the boom 48 attached to it is rotatable upwardly and downwardly. There are times when the operator of the snow plow wants to raise and lower the snow plow blade. To this end a lift system 58 is provided to raise and lower the boom 48 and thereby raise and lower the snow plow blade 46. As shown in FIGS. 3–6, the lift system 58 includes a hydraulically actuated lift cylinder 60. The lift cylinder 60 includes a piston head 62 within a cylinder unit 64 and feed lines 66 and 68 for supplying and withdrawing an operating fluid, such as hydraulic fluid, from chambers 70 and 72 on opposite sides of the piston head 62. The feed lines 66 and 68 communicate with a hydraulic fluid source (not shown) and/or a pump (not shown).

Figure 7:
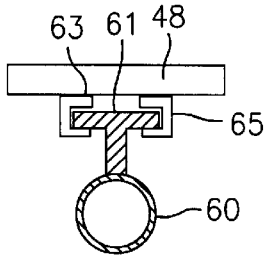
FIG. 7 is a sectional view showing the track system for the lift cylinder.

The lift cylinder 60 preferably is mounted to the boom 48 via a track system 74 to permit reciprocating movement of the lift cylinder 60 along the boom 48. The track system 74 may comprise any suitable track system known in the art for allowing the lift cylinder 60 to be reciprocally moved along the boom 48. For example, as shown in FIG. 7, the cylinder 60 may have a T-shaped member 61 which rides in a track 63 formed by two U-shaped channels 65 attached to the underside of the boom 48. Any suitable means known in the art may be used to cause the lift cylinder 60 to move reciprocally within the track 63.

If desired, the lift cylinder 60 may be attached to the support plate 34 via a rotatably movable connecting arm 88. The connecting arm 88 may be provided to allow the cylinder 60 to move with the boom 48 as the boom 48 travels through the arc B.

The piston head 62 has an operating arm 76 extending from one side. The operating arm 76 has attached to it a first pulley 78. A connecting head or plate 80 may be attached to one side of the pulley 78.

Figure 5:
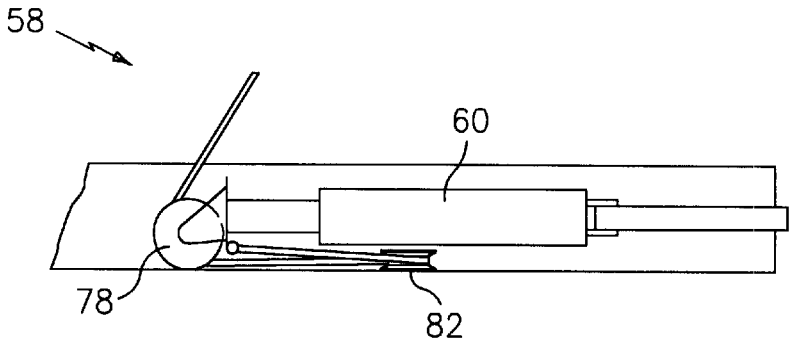
FIG. 5 is a side view of a portion of the boom lift system.
Figure 6:
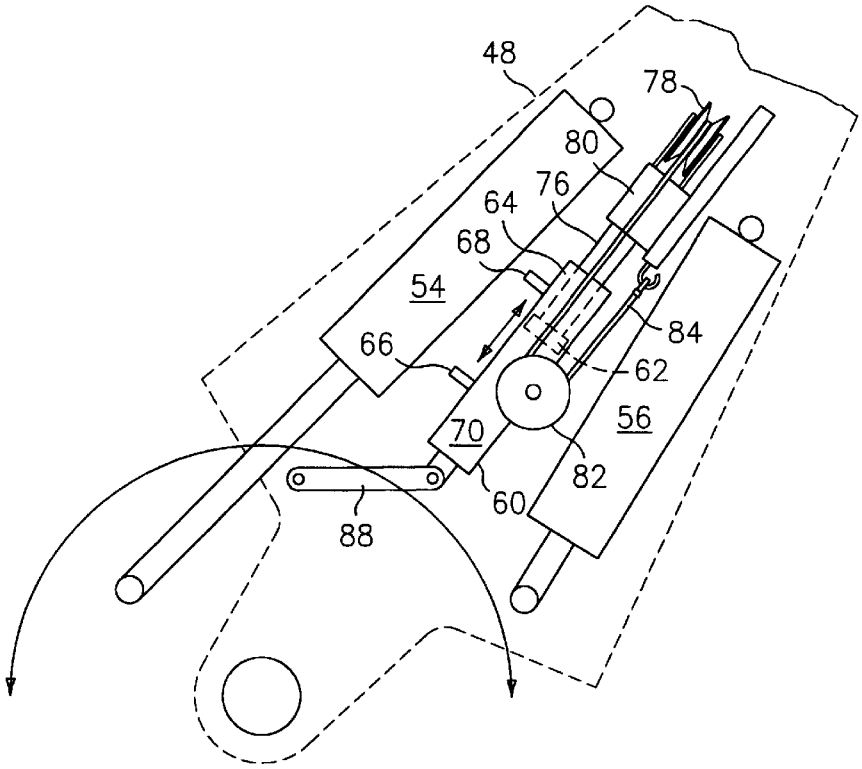
FIG. 6 is a bottom view of the boom showing a portion of the lift system.

The lift system 58 further includes a second pulley 82 attached to the boom 48 and a lift cable 84. As shown in FIGS. 1, 5, and 6, the lift cable 84 has one end attached to the upper portion 86 of the frame 14. The lift cable 84 extends from the upper portion 86 through a hole (not shown) in the boom 48 and passes around a portion of each of the pulleys 78 and 82. Appropriate guards (not shown) may be provided to prevent the lift cable 84 from slipping out of the groove in each of the pulleys 78 and 82. The second end of the lift cable 84 is attached to a portion of a levelling device.

In a boom neutral position, the piston head 62 is centrally positioned within the cylinder 64. To raise or lower the boom 48, the lift cylinder 60 is operated to extend or retract the pulley 78 relative to the cylinder 64.

During normal operation of the snow plow assembly, the boom 48 may be caused to move upward or downward as a result of the snow plow blade 46 traversing along a roadway or a road surface. In systems currently being used, such sudden movement of the boom can cause the lift cable to go slack and consequently fall off and separate from the pulley attached to the lift cylinder. To prevent this from occurring, the levelling device is incorporated into the lift system of the present invention so that the lift cable 84 is always maintained in tension.

Figure 8:
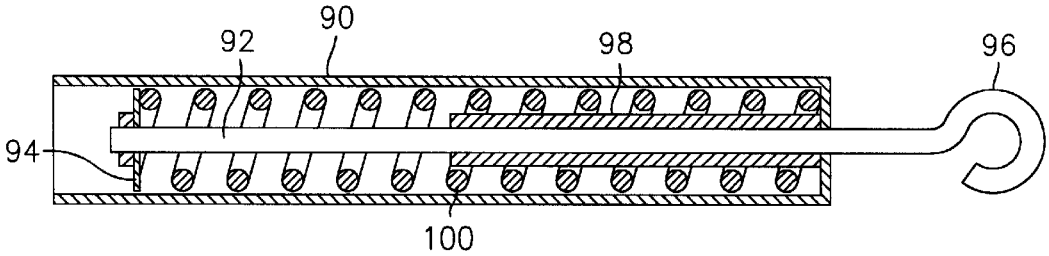
FIG. 8 is a sectional view of a slide tube used in the lift system.

As shown in FIG. 8, the levelling devices comprises a spring tube 90 having a sliding arm 92 with a plate 94 attached at one end and an eye 96 to which the second end of the lift cable 84 is attached. The spring tube 90 also has an internal sleeve 98 through which the sliding arm 92 passes and a spring 100 extending between an end of the tube 90 and the plate 94.

Figure 9:
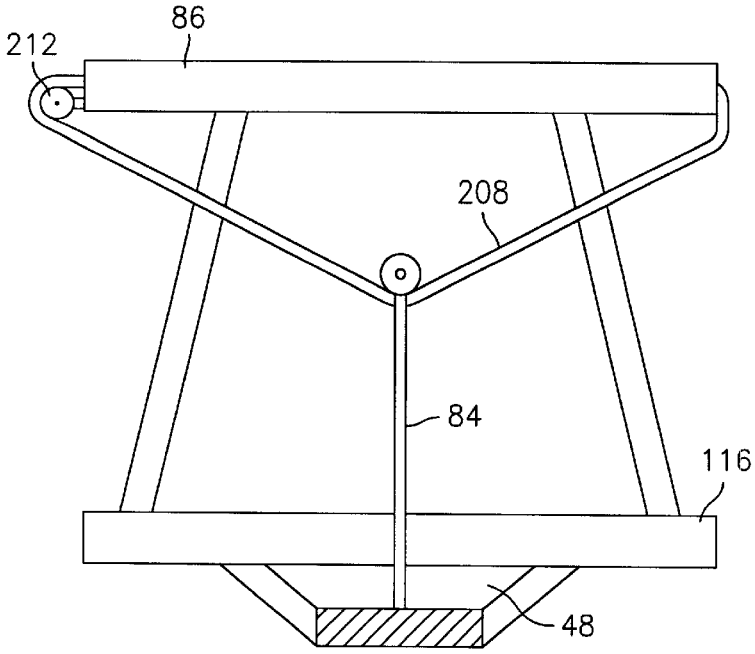
FIG. 9 is a front view of a portion of the frame used to support the boom and snow plow assembly.
Figure 10:
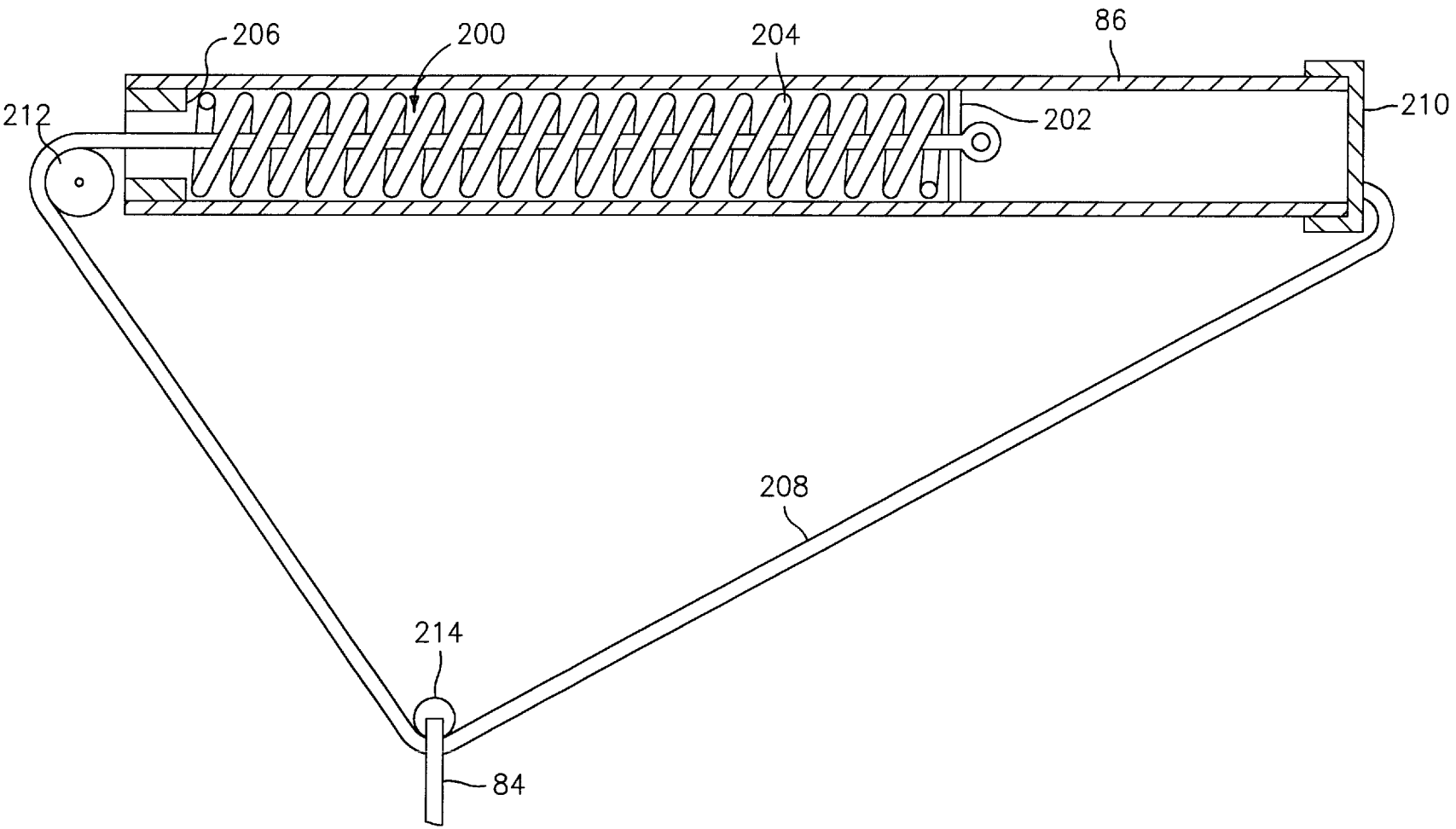
FIG. 10 is a sectional view of a portion of the frame of FIG. 9 and a system for keeping the lift cable taut.

If desired, the levelling device can include additional means to keep the lift cable 84 taut. Referring now to FIGS. 9 and 10, the additional means can take the form of a spring tube 200 incorporated into the upper frame portion 86. The spring tube 200 has a plate 202 which abuts against one end of a spring 204. The other end of the spring 204 rests against shoulders 206. One end of a cable 208 is connected to the plate 202 using any suitable means known in the art. The opposite end of the cable 208 is attached to a closed end 210 of the upper frame portion 206. The cable 208 is passed over a pulley 212 attached to an open end of the upper frame portion 86. The pulley 212 may be secured to the upper frame portion 86 using any suitable means known in the art.

The additional means may further include a pulley 214 which is free to travel along cable 208. Any suitable means known in the art may be used to maintain the pulley 214 on the cable 208. In this embodiment, the lift cable 84 is attached to the pulley 214 instead of one end of the lift cable 84 being attached to the upper frame portion 86.

The spring 204 in the spring tube keeps the cable 208 taut even when the snow plow blade is caused to lift other then hydraulically, such as when piling up snow. By keeping the cable 208 taut, the lift cable 84 is kept taut. A stop (not shown) is placed in the spring tube 200 to limit how far cable 208 can reel out.

The ability for the pulley 214 to travel along the cable 208 is significant. It means that as the boom 48 is moved through the arc B, the lift cable 84 is always kept taut.

Figure 11:
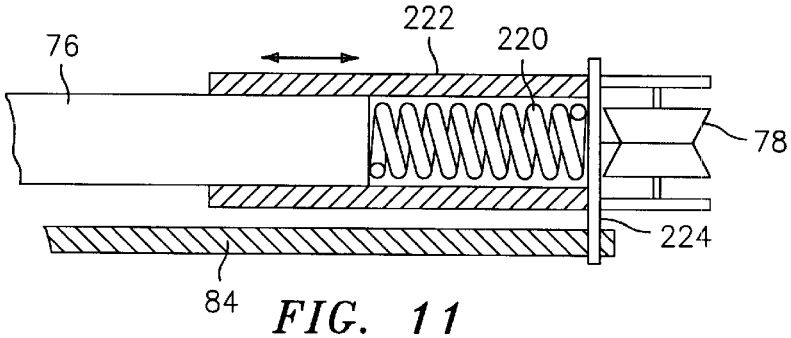
FIG. 11 is a cross sectional view of an alternative system for tensioning the lift cable.

Referring now to FIG. 11, if desired, spring tube 90 may be omitted and replaced by a spring 220 positioned within a tube 222 to which the pulley 78 is fastened. The tube 222 fits over the operating arm 76 and is slidably engaged therewith.

Any suitable means known in the art, such as a cam follower and a track, may be used to form the sliding connection between the arm 76 and the tube 222. In this approach, the second end of the lift cable 84 is secured to a plate 224 which is connected to the pulley 78.

Figure 12:
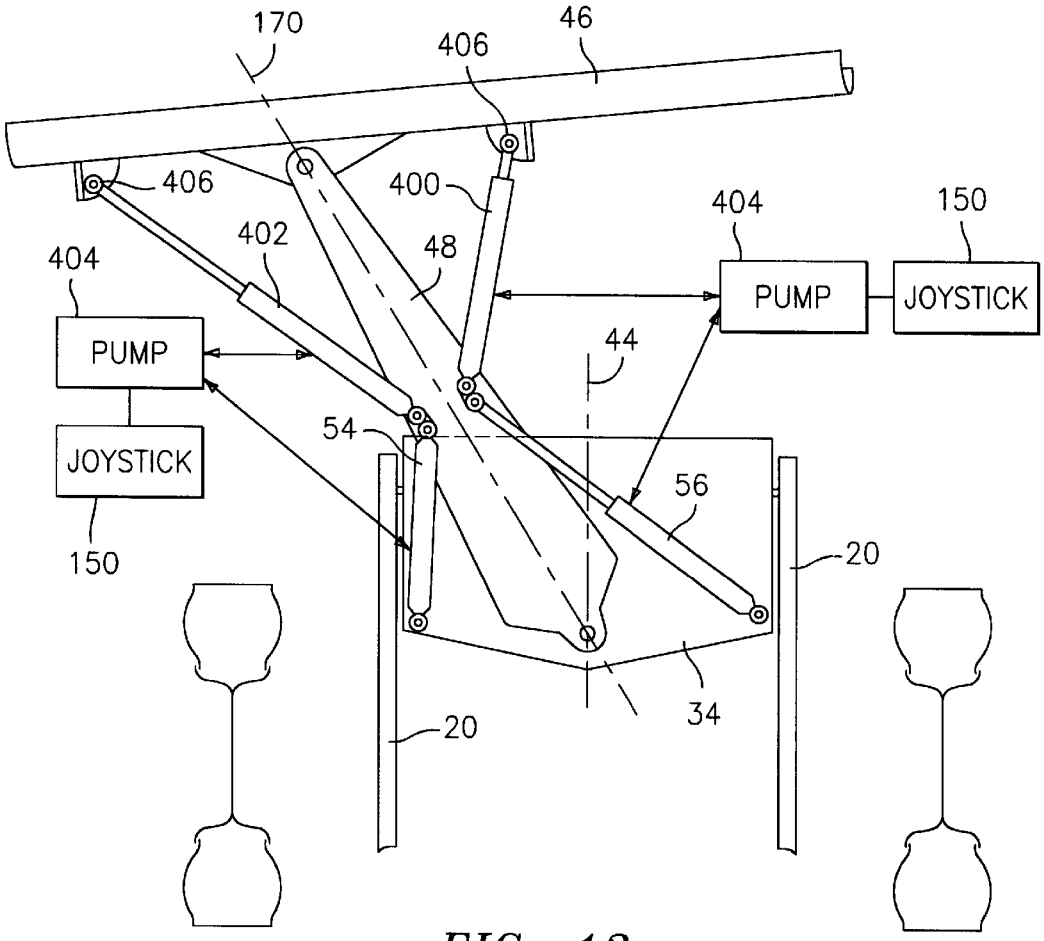
FIG. 12 is a bottom view of the boom and snow plow blade and the units for rotating the boom and the snow plow blade.

Referring now to FIGS. 1 and 12, the snow plow blade 46 is mounted to the boom 48 so that it can move relative to the central longitudinal axis 170 of the boom 48 and the central longitudinal axis 38 of the vehicle 12. While any suitable system known in the art may be used to move the blade 46 relative to the boom, it is preferred to provide a pair of fluid operated actuation units 400 and 402. The units 400 and 402 may comprise any suitable devices known in the art such as hydraulic or pneumatic piston-cylinder units. Each unit 400, 402 has one end rotatably connected to the boom 48 and a second end rotatably connected brackets 406 on the rear of the blade 46. The units 400 and 402 are connected via control lines to a pump or motor 404 which is operated by a joystick 150 within the cab or passenger compartment of the vehicle.

To support the upper end of the snow plow blade 46, an arm 102 may extend upwardly from the boom 48 and an arm 104 may be attached to the back side 106 of the snow plow blade 46. The arm 102 is preferably connected to the arm 104 by a pin connection 108 to allow rotation of the blade 46 relative to the boom 46.

As shown in FIG. 1, the arm 104 also acts as a support for a directional light 110 which may be mounted to the arm 104 by a support member 112. The directional light 110 preferably extends above the upper edge 114 of the blade 46. This overcomes a deficiency of current snow plow assemblies—namely, the lack of appropriate lighting which allows an operator to see clearly what areas have been plowed.

If desired, a lift limiter bar 116 may be incorporated into the frame 14. The lift limiter bar 116 when employed acts to limit the upward rotation of the boom 48 and hence the snow plow blade 46. The limiter bar 116 may be fixedly secured to the frame 14 in any suitable manner known in the art.

Referring now to FIG. 1, the snow plow blade 46 is provided with one or more rolling, triangularly shaped cutting edges 120. Each cutting edge 120 is preferably provided with a pin 122 at each end. Each pin 122 is designed to fit within a bearing assembly 124 in an arm 126 extending downwardly from the snow plow blade 46. Each arm 126 may be integrally formed with the snow plow blade or attached to a side wall of the snow plow blade in any desired manner known in the art.

The snow plow blade 46 further includes a leaf spring 128 mounted to the rear of the snow plow blade and a roller or wheel 130 attached to the leaf spring 128 by a bracket 132. The leaf spring 128 may be mounted to the rear of the snow plow blade 46 in any suitable manner known in the art. The spring tensioned wheel 130 acts as a detent positioner which allows the snow plow blade 46 to roll over solid objects, such as manhole covers. The triangularly shaped cutting edge 120 also provides a cutting edge for backblading or dragging snow backwards. By using such a cutting edge to backblade the snow, less shock is transmitted towards the vehicle 12.

Figure 14:
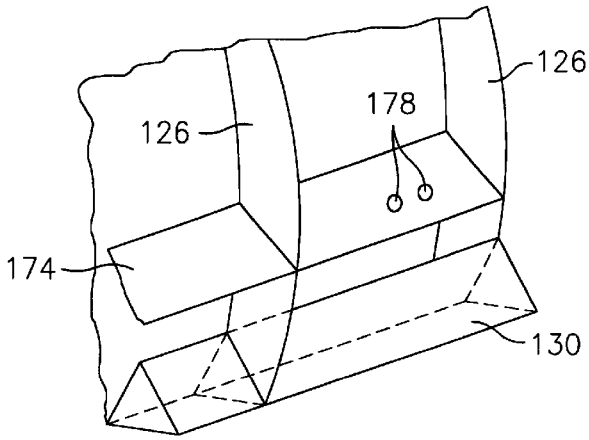
FIG. 14 is a rear view of a portion of the snow plow blade.
Figure 13:
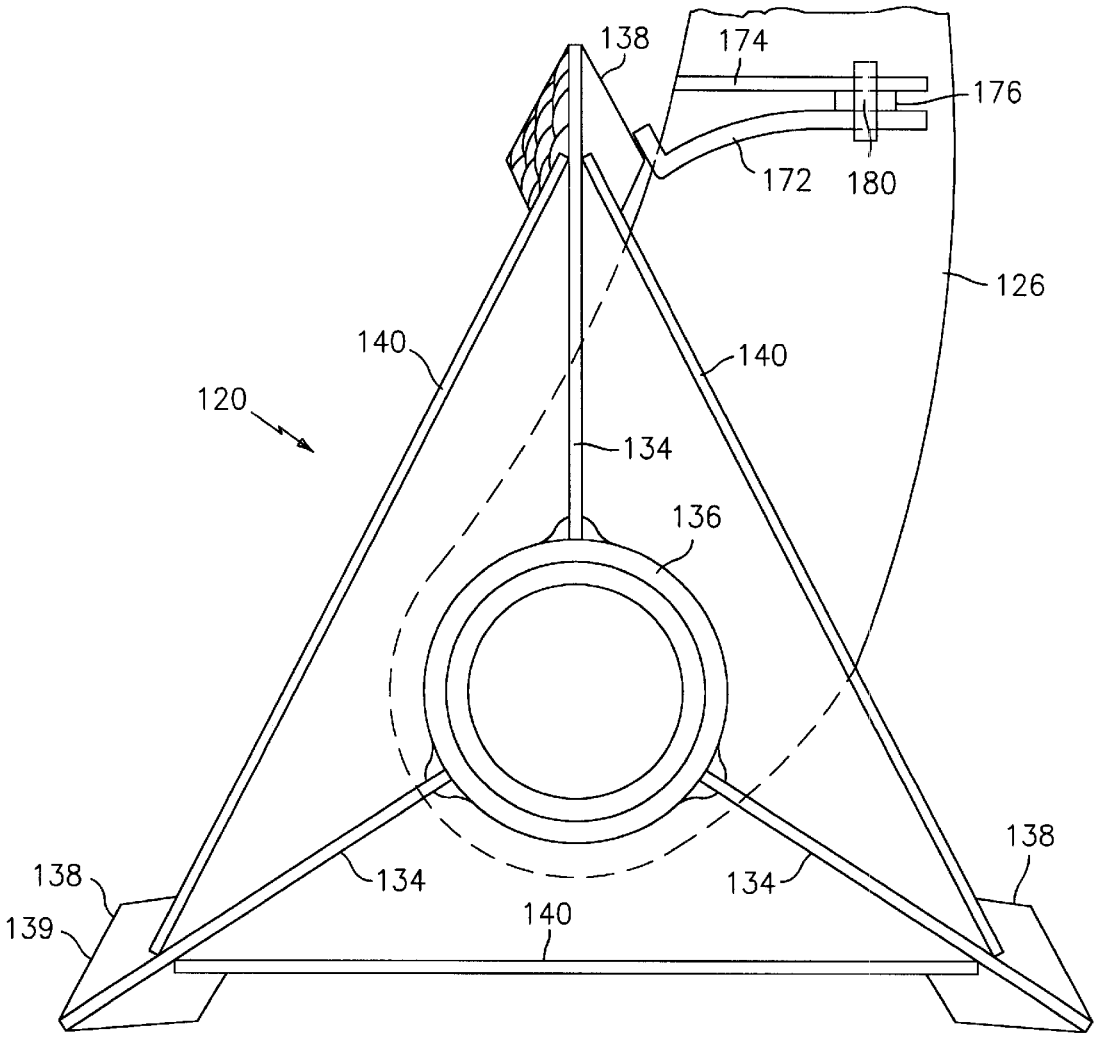
FIG. 13 is a sectional view of a cutting edge used with the snow plow blade.

As shown in FIG. 13, the triangularly shaped cutting edge 120 is formed with three spokes 134 mounted to or secured to a core member 136. The cutting edge 120 also has three structural members 140 which are welded or otherwise joined to each of the spokes 134 to give the edge its triangular shape. The cutting edges are formed by three substantially diamond shaped members 138 joined to the spokes 134 and the structural members 140 such as by welding. Each member 138 is formed with a hardened face 139. This type of cutting edge is lightweight, strong and very durable. Further, the cutting edges formed by members 138 are easily replaceable. In order to prevent the cutting edge 120 from rotating rearwardly during backblading, a stop formed from a piece 172 of spring steel is secured to a flange 174 attached to adjacent side arms 126. A shim 176 is preferably placed between the flange 174 and the piece 172 of spring steel to properly position the stop. FIG. 14 illustrates the rear of snow plow blade 46 and the flanges 174 for supporting the spring steel stops. As can be seen from this figure, each flange has apertures 178 for receiving attaching bolts 180.

Figure 15:
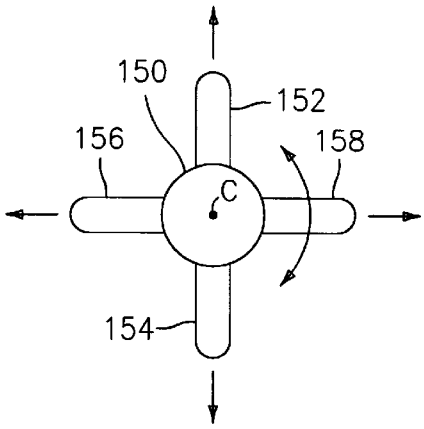
FIG. 15 illustrates a joystick control for operating the boom, the lift system and the snow plow tilt system.

As previously discussed, the snow plow assembly 10 is capable of a variety of movements. For example, the snow plow blade 46 can be raised or lowered via the lift system. Additionally, the snow plow blade 46 can be titled relative to the boom 48 so that the blade 46 can follow a curved path. Still further, the boom 48 itself can be moved through an arc B. FIG. 15 illustrates one type of joystick control 150 which may be used to control the lift system, the actuation units 54 and 56 for moving the boom 48 through the arc B, and the actuation units 400 and 402 for moving the blade 46 from side to side. As shown therein, the joystick 150 is movable forwards and backwards in slots 152 and 154. By moving the joystick forward in slot 152, the lift system is operated to lower the boom 48 and hence the snow plow blade 46. By moving the joystick backward in slot 154, the lift system is operated to raise the boom 48 and hence the snow plow blade 46. The joystick 150 is also movable left and right in slots 156 and 158. By moving the joystick 150 into the slot 156, the cylinders 54 and 56 are operated to move the boom 48 to the left. By moving the joystick 150 into the slot 158, the cylinders 54 and 56 are operated to move the boom 48 to the right. The joystick 150 is also rotatable about the axis C. By rotating the joystick 150 to the left, the snow plow blade 46 is rotated to one side and by rotating the joystick in the opposite direction, the snow plow blade 46 is rotated to the other side.

Figure 16:
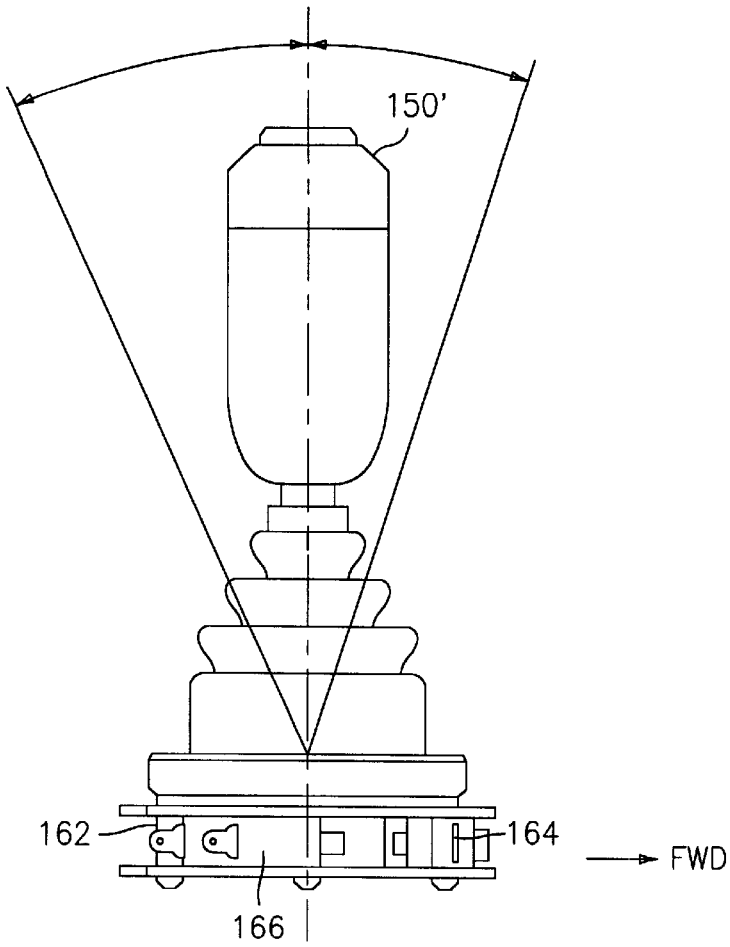
FIGS. 16 and 17 illustrate an alternative joystick control.
Figure 17:
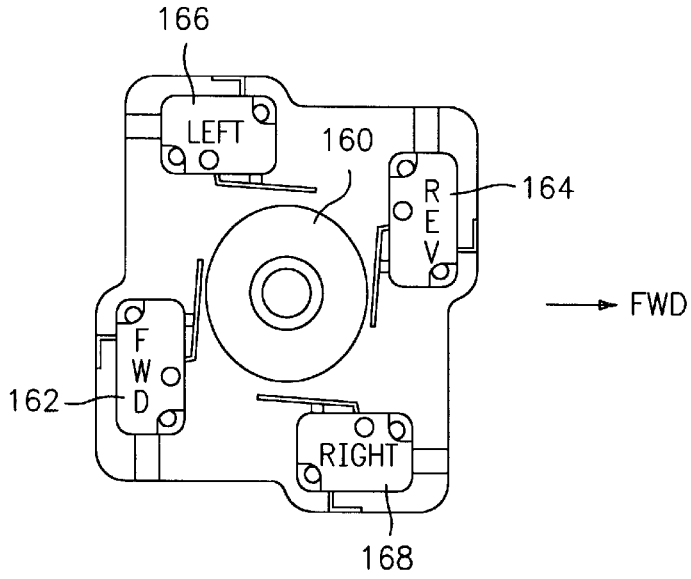

Referring now to FIGS. 16 and 17, an alternative joystick control 150' is illustrated. The joystick 150' also can be moved forwards, backwards, side to side, and angularly. As shown in these figures, the movement of the joystick 150' causes contact between contact element 160 and one or more of switches 162, 164, 166, and 168. The switches 162, 164, 166, and 168 when activated individually or collectively transmit control signals to the controllers (not shown) for driving the lift cylinder 60 in the lift system, the boom actuation units 54 and 56 for rotating the boom 48 relative to the support plate 34 and blade actuation units 400 and 402 for moving the blade 46 relative to the boom 48. As before, forward movement may be used to lower the boom 48, backward movement may be used to raise the boom 48, one side movement may be used to rotate the boom in one direction, and the other side movement may be used to rotate the boom in the opposite direction. The angular movements may be used to contact more than one switch and operate actuation units 400 and 402.

The joystick 150' may also be a variable speed joystick so that variable rates of movement may be imported to the boom and the blade.

Figure 18:
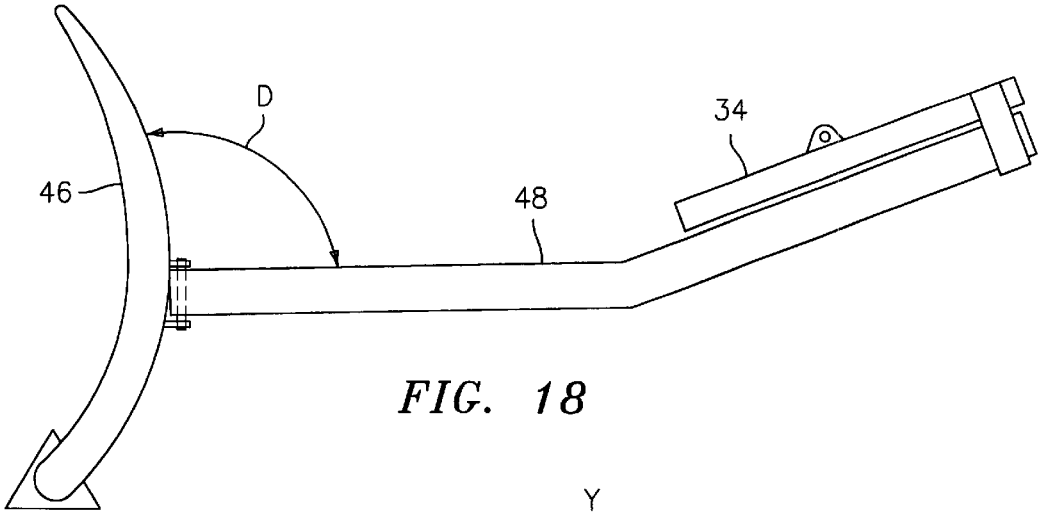
FIG. 18 illustrates an alternative boom embodiment.

While boom 48 has been shown as extending in a linear manner, it may in fact be bent in the middle. Such a boom construction is illustrated in FIG. 18. By bending the boom 48 in the middle, a larger clearance can be obtained with respect to frame 14. As a result, the snow plow blade 46 can be lifted higher.

Figure 19:
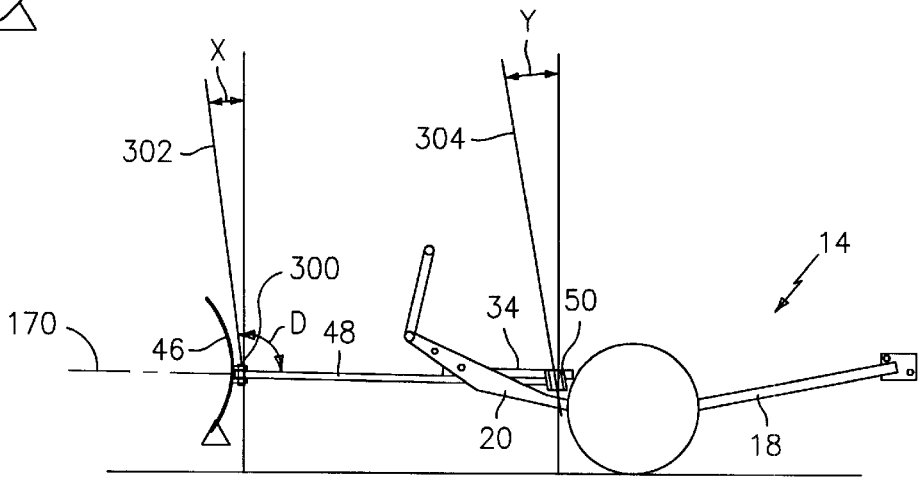
FIG. 19 illustrates a snow plow assembly with a tilted snow plow blade.

Referring now to FIG. 19, the snow plow blade 46 may be connected to the boom 48 with a connection 300 having an axis 302 which forms an angle D greater than 90° with respect to the boom axis 170. Further, the crank pin 50 may be angled so that it rotates about an axis 304. By leaning the axis 302 forward, when the boom 48 is angled all the way to one side, the blade 46 rotates on the boom axis 170 and gives the boom 48 a natural rise. This offsets the tendency of the corner of the blade 46 to touch the ground when the blade 46 is raised and angled all the way to one side. In a preferred embodiment of this aspect of the invention the angle X should be less than the angle Y.

While the snow plow blade 46 may be formed from any suitable material known in the art, it is preferred to form it from a molybdenum-chromium alloy. Similarly, other parts of the snow plow blade assembly may be made from any suitable material known in the art including a molybdenum-chromium alloy.

While the boom 48 has been show as being connected to the support plate 34 by a crank pin 50, the crank pin 50 could be replaced by a ball-type connection.

If desired, as shown in FIG. 1, guides 310 may be placed on top of and/or on the side of the blade 46. By using the guides 310, an operator can easily see whether the blade 46 is centered and level.

Figure 20:
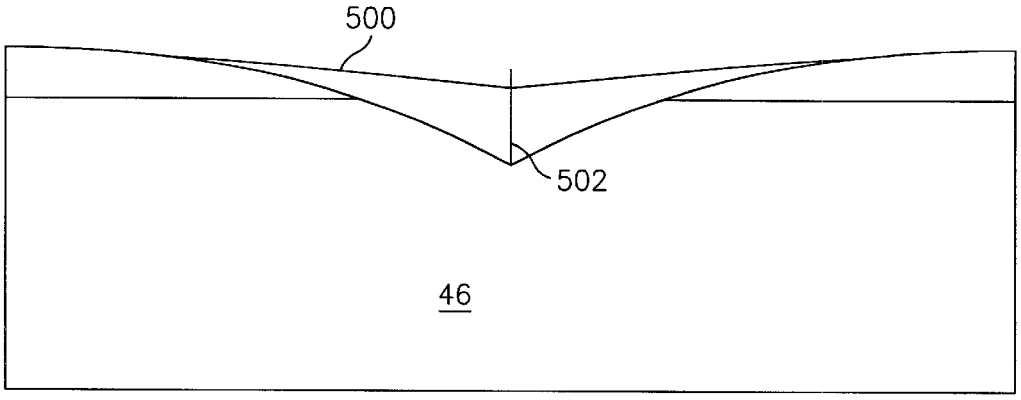
FIG. 20 is a front view of a snow plow assembly having a curl bar.

Referring now to FIG. 20, the snow plow blade 46 may have a curl bar 500 mounted along an upper edge to prevent snow from being thrown into the windshield. The curl bar 500 redirects the snow back down to the road and outwardly toward the sides. The outward direction of the snow is caused by the central V-portion 502 of the curl bar 500.

The curl bar 500 is preferably formed from one or more sheets of metal to which the necessary curvature has been imparted. A plurality of support bars (not shown) are welded or otherwise joined to the rear surface of the curl bar. Besides providing the curl bar with additional strength, the support bars are used to secure the curl bar to the snow plow blade 46. For example, the support bars may be joined to arms 126 using any suitable means known in the art.

The provision of the curl bar 500 is significant in that it enables the vehicle to which the snow plow blade assembly is attached to travel faster.

While the snow plow assembly of the present invention is hinged, the triangularly shaped cutting edge 120 described herein could be used with a non-hinged, two motion (up and down) snow plow blade assembly to hold the snow plow blade more erect. When used in such an environment, the cutting edge 120 would be mounted to the blade in the manner shown herein.

It is apparent that there has been provided in accordance with the present invention a snow plow assembly which fully satisfies the objects, means, and advantages set forth hereinbefore. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and the broad scope of the appended claims.

What is claimed is:

1. A snow plow assembly for use with a vehicle which comprises:

a snow plow blade;

a frame for mounting the snow plow blade to said vehicle;

a boom connected to said frame and said snow plow blade;

a lift system for raising and lowering said boom, said lift system including a lift cable attached to said frame and said boom;

means for maintaining said lift cable taut so that said snow plow blade remains substantially level during use;

said lift system including a lift cylinder mounted to said boom;

said lift cylinder having an operating arm extending from one end; and a first pulley secured to an end of said operating arm, whereby said first pulley is extended by said lift cylinder via said operating arm to raise said boom and is retracted by said lift cylinder via said operating arm to lower said boom.

2. A snow plow assembly according to claim 1, wherein:

said lift system includes a second pulley secured to said boom, said lift cable being partially wrapped about said pulley;

said means for maintaining said lift cable taut further comprises a spring tube mounted to said first pulley; and a first end of said lift cable is attached to said spring tube and a second end of said lift cable is attached to an upper portion of said frame.

3. A snow plow assembly according to claim 1, further comprising:

said first pulley being secured to an end of said operating arm via a hollow tube which fits over said operating arm;

a second pulley secured to said boom; and said lift cable having a first end which is connected to a plate attached to said first pulley, an intermediate portion which extends about a portion of said first pulley and a portion of said second pulley, and a second end attached to an upper portion of said frame.

4. A snow plow assembly according to claim 3, wherein said hollow tube is slidingly engaged with said operating arm.

5. A snow plow assembly according to claim 3, wherein said tension maintaining means comprises a spring positioned within said hollow tube, said spring having a first end abutting said end of said operating arm and a second end abutting said plate attached to said first pulley.

6. A snow plow assembly according to claim 1, further comprising:

said frame having an upper portion formed by a hollow tube having a closed end and an end with an opening;

said hollow tube including a spring tube having a spring cooperating with an internal plate;

a second pulley attached to said hollow tube adjacent said end with said opening;

a tensioning cable having a first end attached to said internal plate and a second end attached to said closed end; and said lift cable being joined to said tensioning cable.

7. A snow plow assembly according to claim 6, wherein said lift cable is joined to said tensioning cable via a third pulley.

8. A snow plow assembly according to claim 7, wherein said third pulley is free to travel along said tensioning cable when said boom moves from side to side.

9. A snow plow assembly according to claim 1, further comprising:

a track mounted to said boom; and said lift cylinder being reciprocally movable along said track.

10. A snow plow assembly according to claim 1, further comprising:

said frame including a support plate for said boom;

a connector integral with said boom for joining said boom to said support plate and for permitting said boom to move relative to said support plate.

11. A snow plow assembly according to claim 10, further comprising a connecting arm joining an end of said lift cylinder to said support plate and for allowing said lift cylinder to move with said boom.

12. A snow plow assembly according to claim 10, further comprising means for moving said boom assembly relative to a longitudinal axis of said vehicle and said support plate.

13. A snow plow assembly according to claim 12, wherein said moving means comprises at least two actuation units and wherein each said actuation unit has a first end connected to said boom and a second end connected to said support plate, whereby said at least two actuation units may be operated to move said boom through an arc.

14. A snow plow assembly according to claim 13, wherein a first one of said actuation units is placed on a first side of said lift cylinder and a second one of said actuation units is placed on a second side of said lift cylinder.

15. A snow plow assembly according to claim 1, further comprising said frame being releasably mounted to a frame of said vehicle.

16. A snow plow assembly according to claim 15, further comprising said frame including two side portions with each side portion having a first member connected to said vehicle frame and a second member connected to said vehicle frame by a quick disconnect device.

17. A snow plow assembly according to claim 16, further comprising said second member being connected to said first member by a quick disconnect device.

18. A snow plow assembly according to claim 16, wherein said second member has a funnel device for receiving an end of said first member.

19. A snow plow assembly according to claim 16, further comprising a supporting plate and rotation means for allowing said supporting plate and said boom to rotate relative to said second member.

20. A snow plow assembly according to claim 19, wherein said rotation means comprises a member attached to said support plate and having two ends which rotatably engage said second frame members.

21. A snow plow assembly according to claim 16, wherein said frame further comprising means for limiting upward movement of said boom joined to said side portions.

22. A snow plow assembly according to claim 1, further comprising:

a directional light mounted to said boom to move with said boom.

23. A snow plow assembly according to claim 22, wherein said directional light is positioned above an upper surface of said snow plow blade.

24. A snow plow assembly according to claim 22, further comprising:

an arm extending angularly upwardly from said boom, said arm having an end connected to said snow plow blade for supporting said snow plow blade; and said directional light being mounted to said boom via said arm.

25. A snow plow assembly according to claim 1, further comprising guides on at least one of the top and the sides of said snow plow blade to permit an operator to determine whether the snow plow blade is centered and level.

26. A snow plow assembly according to claim 1, further comprising a joystick control for moving the boom with respect to a longitudinal axis of said vehicle, for operating said lift cylinder to raise and lower the snow plow blade, and to move said snow plow blade from side to side relative to a central axis of said boom.

27. A snow plow assembly according to claim 26, wherein said joystick is movable within a first pair of slots to move the boom relative to said longitudinal axis of said vehicle, said joystick is movable within a second pair of slots to raise and lower the snow plow blade, and said joystick rotates to move said snow plow blade from side to side.

28. A snow plow assembly according to claim 26, wherein said joystick has two pairs of switches for sending control signals to actuators for moving the boom relative to said vehicle, to said lift cylinder to raise and lower the boom, and to actuators to move said snow plow blade from side to side and wherein said joystick contacts at least one of said switches when it is moved forward, backward, side-to-side and at an angle.

29. A snow plow assembly according to claim 1, further comprising a curl bar mounted to said snow plow blade for redirecting snow downwardly and outwardly.

30. A snow plow assembly according to claim 29, wherein said curl bar has a central V-shaped portion.

31. A snow plow blade assembly for use with a vehicle which comprises:

a snow plow blade;

a frame for mounting the snow plow blade to said vehicle;

a boom connected to said frame and said snow plow blade;

a lift system for raising and lowering said boom, said lift system including a lift cable attached to said frame and said boom;

means for maintaining said lift cable taut so that said snow plow blade remains substantially level during use;

said frame being releasably mounted to a frame of said vehicle and including two nonlinear side portions attached to said vehicle frame;

each of said side portions comprising a first member attached to an outside portion of said vehicle frame by two spaced apart connecting members and a second member connected to said first member and also attached to said outside portion of said vehicle frame by a connecting member.

32. A snow plow blade assembly according to claim 31, wherein said first member is connected to said second member by quick connect/disconnect means.

33. A snow plow blade assembly according to claim 32, wherein said quick connect/disconnect means a funnel shaped portion attached to an end of said second member for receiving a free end of said first member.

34. A snow plow blade assembly according to claim 31, further comprising an upper frame portion connected to each side portion and extending between said side portions.

35. A snow plow assembly according to claim 31, further comprising means for limiting upward movement of a boom joined to said frame.

* * * * *